US009693673B2

(12) United States Patent
Disch et al.

(10) Patent No.: US 9,693,673 B2
(45) Date of Patent: Jul. 4, 2017

(54) WAREWASHER COMPRISING A DRYING SYSTEM AND METHOD FOR OPERATING SUCH A WAREWASHER

(71) Applicants: Harald Disch, Elzach (DE); Dietrich Berner, Waldstetten (DE); Allen Jakway, Zell am Hamersbach (DE)

(72) Inventors: Harald Disch, Elzach (DE); Dietrich Berner, Waldstetten (DE); Allen Jakway, Zell am Hamersbach (DE)

(73) Assignee: PREMARK FEG L.L.C., Glenview, IL (US)

( * ) Notice: Subject to any disclaimer, the term of this patent is extended or adjusted under 35 U.S.C. 154(b) by 291 days.

(21) Appl. No.: 14/413,366

(22) PCT Filed: Jul. 16, 2013

(86) PCT No.: PCT/US2013/050591
§ 371 (c)(1),
(2) Date: Jan. 7, 2015

(87) PCT Pub. No.: WO2014/014857
PCT Pub. Date: Jan. 23, 2014

(65) Prior Publication Data

US 2015/0190032 A1 Jul. 9, 2015

(30) Foreign Application Priority Data

Jul. 18, 2012 (DE) ..... 10 2012 212 636

(51) Int. Cl.

| | |
|---|---|
| ***B08B 3/00*** | (2006.01) |
| ***A47L 15/48*** | (2006.01) |
| ***A47L 15/00*** | (2006.01) |

(52) U.S. Cl.
CPC ..... *A47L 15/481* (2013.01); *A47L 15/0047* (2013.01); *A47L 15/488* (2013.01); *A47L 2501/10* (2013.01); *A47L 2501/12* (2013.01)

(58) Field of Classification Search
CPC .. A47L 15/0047; A47L 15/481; A47L 15/488; A47L 2501/12; A47L 2501/10
(Continued)

(56) References Cited

U.S. PATENT DOCUMENTS 7,846,270 B2 12/2010 Jerg et al.
2006/0278257 A1* 12/2006 Jerg ..... A47L 15/481 134/56 D (Continued)

FOREIGN PATENT DOCUMENTS

DE 102005004096 6/2006
DE 102005023429 11/2006

(Continued)

OTHER PUBLICATIONS

PCT, International Search Report and Written Opinion, International Application No. PCT/US2013/050591; date of mailing Jan. 29, 2015, 10 pages.

(Continued)

*Primary Examiner* — Binh X Tran
*Assistant Examiner* — David Cathey, Jr.
(74) *Attorney, Agent, or Firm* — Thompson Hine LLP

(57) ABSTRACT

A warewasher (1) provided as a box-type warewasher and a method for operating such a warewasher (1) are provided. In accordance with the warewasher and method, during the adsorption phase, air is guided from the treatment chamber (2) of the machine (1) through a drying unit (40) in such a way that moisture from the airflow is absorbed by a dry material, wherein the air is then fed again to the treatment chamber (2). Furthermore, the drying device is arranged (Continued)

above the treatment chamber (2) so as to effectively prevent penetration of splashed water into the drying device (40).

9 Claims, 3 Drawing Sheets

(58) Field of Classification Search
USPC ..... 134/25.2, 95.2
See application file for complete search history.

(56) References Cited

U.S. PATENT DOCUMENTS

| | | | | |
|---|---|---|---|---|
| 2007/0295373 | A1 | 12/2007 | Jerg et al. | |
| 2008/0295875 | A1 | 12/2008 | Jerg et al. | |
| 2008/0314414 | A1 | 12/2008 | Hildenbrand | |
| 2010/0043842 | A1* | 2/2010 | Jerg | A47L 15/481 134/95.2 |
| 2011/0017235 | A1 | 1/2011 | Berner et al. | |
| 2011/0114136 | A1* | 5/2011 | Jerg | A47L 15/4251 134/115 R |
| 2011/0139197 | A1 | 6/2011 | Jerg et al. | |
| 2012/0055519 | A1 | 3/2012 | Hong et al. | |
| 2012/0240965 | A1 | 9/2012 | Jerg et al. | |

FOREIGN PATENT DOCUMENTS

| | | |
|---|---|---|
| DE | 102008017597 | 10/2009 |
| DE | 102008039894 | 3/2010 |
| EP | 1833354 | 9/2007 |
| EP | 1997419 | 12/2008 |
| EP | 2399503 | 12/2011 |
| JP | 2006020753 | 1/2006 |
| WO | 2013/081868 | 6/2013 |

OTHER PUBLICATIONS

PCT, International Search Report and Written Opinion, PCT/US2013/050591, Jul. 23, 2014.

* cited by examiner

WAREWASHER COMPRISING A DRYING SYSTEM AND METHOD FOR OPERATING SUCH A WAREWASHER

The invention relates to a warewasher, in particular a commercial warewasher provided as a box-type warewasher, comprising a drying system, and also to a method for operating such a warewasher.

Box-type warewashers are warewashers that can be manually loaded and unloaded. Box-type warewashers (also referred to as batch dishwashers) may be crockery rack pass-through warewashers, also referred to as hood-type warewashers, or front loader warewashers. Front loader warewashers may be undercounter machines, top counter machines or free standing front loaders.

A warewasher formed as a box-type warewasher normally has a treatment chamber for cleaning items to be washed. A washing tank, in which liquid from the treatment chamber can flow back as a result of gravity, is generally arranged beneath the treatment chamber. Washing liquid, which is normally water, to which cleaning agent can be fed as necessary, is located in the washing tank.

Further, a warewasher formed as a box-type warewasher normally has a washing system with a washing pump, a line system connected to the washing pump, and a multiplicity of rinsing jets formed in at least one washing arm. The washing liquid located in the washing tank can be conveyed from the washing pump via the line system to the washing jets and can be sprayed by the washing jets in the treatment chamber onto the items to be cleaned. The sprayed washing liquid then flows back into the washing tank.

Such a warewasher formed as a box-type warewasher is known for example from document DE 10 2005 023 429 A1.

The term "items" used herein is to be understood in particular to mean crockery, glassware, cutlery, cooking utensils, baking utensils and serving trays, but also transport containers, racks, preparation tools and also class I medical devices, in particular bedpans and surgical instruments or components thereof.

A commercial warewasher formed as a box-type warewasher in particular differs from a domestic warewasher in that a commercial warewasher has to be designed in such a way that, irrespective of the selected cleaning program, program running times between one and five minutes can be implemented, whereas domestic warewashers generally have running times of up to 2.5 hours or above. Due to the short program duration required with commercial warewashers, technology used in domestic warewashers cannot generally be easily transferred to commercial warewashers.

Commercial warewashers that are formed as box-type warewashers normally operate in two main process steps: a first step, which includes washing with a washing liquid, and a second step, which includes final rinsing with heated fresh water and final rinse agent added in a metered manner.

In order to carry out these process steps, a commercial warewasher formed as a box-type warewasher is generally equipped with two independent liquid systems, which are completely separate from one another. One liquid system is a washing-water circuit, which is responsible for the washing of the items, wherein the washing process is carried out with recirculated water from the washing tank of the warewasher. The other liquid system is a fresh water system, which is responsible for the final rinse. The final rinse is carried out with fresh water, preferably with fresh water from a boiler. Once sprayed, the fresh water is likewise received by the washing tank of the warewasher.

The primary objective of the final rinse is to remove suds located on the washed items. In addition, the final rinse water flowing into the washing tank during the final rinse step is used for regeneration of the washing water present in the washing tank.

Before fresh water is sprayed in the form of rinsing liquid as a result of the final rinse process and is thus guided into the washing tank of the warewasher, a quantity of washing liquid equal to the quantity of fresh water is drained from the washing tank.

Commercial warewashers that are formed as box-type warewashers are normally equipped with a number of programs. These programs differ primarily by washing process program running times of different length. The operator has the option to select a short washing program with lightly soiled items to be washed or to select a correspondingly longer wash program with heavily soiled items to be washed.

Commercial warewashers that are formed as box-type warewashers and are designed for batchwise loading and unloading of the treatment chamber with items to be washed are front-door machines or rack pass-through machines in particular. In the case of front-door machines, the items to be washed are placed in a rack and the rack loaded with items to be washed is placed through a front door into the treatment chamber of the warewasher and is removed again through the front door after the cleaning process. In the case of rack pass-through machines, the crockery racks loaded with items to be washed are slid manually from an entry side into the treatment chamber and are removed manually from the treatment chamber from an exit side once a rinsing program has finished. Front-door machines and rack pass-through machines contain only a single treatment chamber for treating the items to be washed. The front-door machines may be undercounter machines or overcounter machines.

In the case of commercial warewashers that are formed as box-type warewashers, two drying methods are primarily used. With the first method, the washed items, which are still hot after the final rinse process, are removed from the machine, where they are then dried in the ambient air in four to ten minutes. In order to dry the items, said items in the case of the above-described method are normally left in the racks in which they were arranged for cleaning in the warewasher.

In accordance with the second method, air-drying takes place within the treatment chamber of the warewasher. Fresh air drying systems are used in this case. Fresh drying systems of this type for commercial front-door warewashers or undercounter warewashers always operate with a high air volume flow rate in the range from 25 to 100 $m^3$ per hour in order to be able to dry the washed items remaining in the treatment chamber within a very short time. The high air volume flow rates are due to the shortness of the drying process in the commercial field. Compared to conventional drying of a domestic warewasher, the active drying time of a commercial warewasher is much shorter. Whereas the program running time of a drying process in a domestic warewasher is approximately 30 minutes to 2.5 hours, the program running time of a drying process in commercial use is between 1.5 and 5 minutes.

With air-drying in a commercial warewasher formed as a box-type warewasher, fresh air is drawn in from outside and is guided through the treatment chamber of the warewasher in order to absorb moisture from the washed items to be dried. The drying air charged with moisture is then generally blown out in the form of waste air into the room in which the warewasher is installed.

In particular in scullery areas, in which a plurality of warewashers formed for example as box-type warewashers are operated at the same time in part, the blowing out of the drying air into the installation room leads to a negative influence on the room climate, since the moisture content of the air in the installation room (ambient air) is inevitably increased by blowing out the drying air, which is charged with moisture and is warm in comparison to the air in the installation room. Here, there is the risk in particular that the moisture content of the air in the installation room is increased so far that undesirable condensation of water vapor occurs in particular at cool interfaces in the installation room.

In order to overcome this problem, it is known from the specialist field of commercial warewashing to first guide the drying air (waste air) to be discharged from the treatment chamber of the warewasher during the drying phase through a drying duct, in which at least some of the moisture contained in the drying air is separated from the waste air by condensation before the subsequently cooled waste air, of which the moisture content is considerably reduced, is then released externally via a blow-out opening of the warewasher, that is to say into the atmosphere of the installation room. More specifically, at least some of the moisture discharged with the drying air from the treatment chamber condenses in the drying duct.

Due to the drying process required with commercial warewashers, which is massively reduced compared to domestic warewashers, there is a risk, which is not to be ignored, that, in particular due to the high air volume flow rate guided through the treatment chamber of the warewasher during the drying phase, condensation water collecting in the drying duct is also blown out through the blow-out opening of the warewasher. There is also a risk that relatively small quantities of washing liquid and rinsing liquid will also reach the drying duct, since the drying duct is generally connected to the interior of the warewasher. In standby phases and in the event of daily start-up or heating of the machine, condensation droplets may also form in the drying duct.

In addition, in the case of commercial warewashers formed as box-type warewashers, the drying duct is generally not sufficiently large to reduce the moisture content of the drying air to be discharged from the treatment chamber of the warewasher to such an extent that said moisture content corresponds to the moisture content of the air (ambient air) in the room in which the warewasher is installed. In the case of conventional warewashers, the blowing out of the waste air into the room in which the warewasher is installed thus inevitably leads to an increase in the moisture of the ambient air, that is to say of the air in the room in which the warewasher is installed.

A problem with the commercial warewashers known from the prior art and formed as box-type warewashers can consequently be considered the fact that, in spite of the provision of a drying duct, there is still an undesirable release of water from the warewasher in the event of the drying process (drying phase) during the program sequence of the warewasher.

Based on the problem explained above, one object of the invention is to provide an option with a warewasher formed as a box-type warewasher, as a result of which on the one hand a discharge of water during operation can be further reduced, wherein in particular it is to be ensured that the warewasher can be operated in the installation room in the simplest manner possible, even without a complex drying duct system. In addition, a further object of the invention is to specify a warewasher that has a reduced energy consumption during operation, wherein in particular it is to be ensured that the warewasher is to be designed in the simplest manner possible.

These objects are achieved with regard to the warewasher formed as a box-type warewasher by the subject matter of independent claim 1, and with regard to the method for operating such a warewasher by the subject matter of the further independent claim, claim 14. Advantageous developments of the warewasher according to the invention are specified in dependent claims 2 to 13, and advantageous developments of the method according to the invention are specified in dependent claims 15 to 19.

Accordingly, in accordance with one aspect of the present invention, a warewasher, in particular commercial warewasher, is proposed, which is provided as a box-type warewasher and has a treatment chamber, into which and from which items to be washed can be introduced and removed manually. The warewasher according to the invention further has a tank, into which liquid from the treatment chamber can flow as a result of gravity, a washing system comprising a washing pump and a washing line system for conveying washing liquid during a washing phase from the tank and for spraying the washing liquid through washing jets in the treatment chamber, and also a fresh water rinsing system comprising at least one rinsing pump and at least one rinsing line system for conveying rinsing liquid during a fresh water rinsing phase from a fresh water feed device and for spraying the rinsing liquid through rinsing jets in the treatment chamber.

The warewasher according to the invention further has a drying device for removing moisture from drying air circulating in the treatment chamber, either continuously or as required. To this end, the drying device has at least one sorption unit having a reversibly dehydratable dry material. The dry material absorbs the moisture of the drying air and, once moisture has been adsorbed by the dry material or once the dry material has absorbed moisture, can regenerate again, as a result of which at least some of the previously absorbed moisture is released again from the dry material (desorption). For this purpose, the dry material of the sorption unit is heated during the "desorption phase", and air from the treatment chamber of the warewasher is guided through the sorption unit comprising the heated dry material.

The dry material for example is a sorption agent that comprises zeolite. Zeolite is a crystalline mineral, which, in the framework structure, contains silicon oxides and aluminum oxides. The regular framework structure contains cavities in which water molecules can be adsorbed with release of heat. Within the framework structure, the water molecules are exposed to strong field forces, of which the strength is dependent on the quantity of water already contained in the lattice structure and on the temperature of the zeolite material. In the present case, type Y zeolite in particular is suitable as dry material, since this material is particularly stable even under extremely hydrothermal conditions.

In accordance with the invention, the above-mentioned drying device is arranged in particular above the treatment chamber. This is to be understood such that at least the sorption unit of the drying device is arranged above the treatment chamber, that is to say for example is installed on the top of the warewasher. Accordingly, the drying unit therefore is not located for example beneath or next to the treatment chamber, but above, that is to say in particular above the washing jets and rinsing jets of the treatment chamber.

Lastly, in the case of the warewasher according to the invention, at least one fan for circulating air as required in such a way that at least some of the air from the treatment chamber is guided through the sorption unit and is then fed again to the treatment chamber is provided. The airflow through the sorption unit comprising the heated dry material is thus preferably produced with the aid of the aforementioned fan, wherein said fan already during the adsorption phase can guide air from the treatment chamber of the warewasher through the sorption unit. Of course, a further (additional) fan can also be used, however, for this purpose.

Specifically, the "reversibly dehydratable dry material" is to be understood to mean a sorption agent or sorbent that is designed to store moisture during an adsorption phase, wherein at least some of the moisture stored during the adsorption phase is removed or released again in a "regeneration phase". As indicated, moisture is removed from the air during the adsorption phase. At the same time, energy is released as a result of the uptake of water by the dry material and consequently heats the dried air. In order to initiate the regeneration phase, energy (for example in the form of heat) has to be fed to the dry material, whereupon said material releases the absorbed water again.

The advantages that can be achieved with the solution according to the invention are obvious: due to the provision of a sorption unit comprising a reversibly dehydratable dry material, air-drying in the treatment chamber of the warewasher is possible with drying air without the drying air then having to be blown out externally into the atmosphere of the room in which the warewasher is installed, since, due to the provision of the sorption unit, the drying air can be continuously recirculated in the treatment chamber. In addition, due to the arrangement of the drying device above the treatment chamber, the condensation water and splashed water is effectively kept away from the sorption unit and thus flows back exclusively into the washing tank as a result of gravity.

At first glance, it initially appears expedient to install the sorption unit equipped with a reversibly dehydratable dry material in the vicinity of the washing tank beneath the treatment chamber and to connect said sorption unit via a line system to the treatment chamber. This would have the advantage that the dehumidified warm air rises automatically into the treatment chamber after flowing through the sorption unit due to the increased temperature, whereas the cooler moist air falls downwards. A natural circulation of air would accordingly be provided, which automatically moves the moist air to be dried from the treatment chamber in the direction of the sorption unit.

A problem with this arrangement of the drying device however is that, in spite of the provision of protection apparatuses, water (for example splashed and condensation water) still collects in the housing of the drying device and is consequently adsorbed by the dry material in addition to the moisture contained in the drying air. In order to again introduce the water into the circulating system, said water would have to be either evaporated during the desorption phase or pumped upwardly by means of a water pump into the treatment chamber or the washing tank. This would be associated with an increased energy expenditure and extended drying times.

It has surprisingly been found that the fitting of the drying unit above the treatment chamber leads to a reduction of the energy consumption, although here the treated dried machine air must be circulated back into the treatment chamber with the aid of a fan. Indeed, as mentioned, it appears to be particularly energy efficient to arrange the drying device beneath the treatment chamber and to allow the heated, dried air to rise independently into the treatment chamber, however this is outweighed by the advantage that a drying device arranged above the treatment chamber is protected more effectively against splashed water or condensation water. In other words, the efficacy of the drying device is significantly increased by the specific arrangement above the treatment chamber, since no splashed water or condensation water can collect within the sorption unit. Even if condensation water for example should find its way into the sorption unit, it can be discharged in the direction of the washing tank in accordance with the invention merely as a result of gravity.

In a preferred embodiment of the warewasher according to the invention, the drying device has an air inlet, which is connected via an inlet line to the treatment chamber. Here, the inlet line is in particular connected laterally or from above to the treatment chamber. As an equivalent, the drying device may have an air outlet, which is connected via an outlet line to the treatment chamber, wherein the outlet line is also connected laterally or from above to the treatment chamber. Depending on the design of the warewasher, the drying device can therefore be connected to the treatment chamber at different access points in order to effectively minimize the spatial requirement of the drying device.

In order to prevent an infiltration of splashed water from the treatment chamber into the drying unit even more effectively, the warewasher may have a first splash protection apparatus between the air inlet and the treatment chamber and/or a second splash protection apparatus between the air outlet and the treatment chamber. It is also conceivable in this regard for the splash protection apparatuses to be formed in such a way that even the infiltration of condensation water into the drying unit is effectively prevented.

In accordance with a further aspect of the warewasher according to the invention, the sorption unit has a thickness of 2 to 100 mm, preferably 10 to 50 mm, and more preferably to 40 mm, along the direction of flow of the airflow guided from the treatment chamber. In other words, the airflow drawn from the treatment chamber passes through a sorption unit with a thickness of 2 to 100 mm during the drying process, whereby sufficient drying of the moist machine air is ensured. In this regard, it is noted that the arrangement of the reversibly dehydratable drying material within the sorption unit is key for the drying effect of the drying device. A relatively high filling height of the dehydratable dry material thus indeed ensures effective drying of the machine air, however the flow resistance is also increased with increasing thickness. For this reason, in accordance with the invention, the sorption unit in particular is to be designed relatively flat, that is to say with a thickness of 2 to 100 mm, and is instead to ensure the most homogeneous distribution possible of the machine air within the sorption unit, as will be explained in greater detail hereinafter.

For the above reasons, the drying device has a first air distributor, which is arranged between the fan and the sorption unit and is designed to direct the airflow perpendicular to an entry surface of the sorption unit. Due to the perpendicular orientation of the airflow to the entry surface of the sorption unit, a particularly homogeneous distribution of the machine air inside the reversibly dehydratable drying material is achieved, whereby effective drying is ensured, even with low thicknesses of the sorption unit. Here, the first air distributor may consist of a multiplicity of air lamellae, which deflect the airflow in such a way that it is directed perpendicular to the entry surface of the sorption unit. Furthermore, as a result of the arrangement of the air lamellae, the airflow through the dry material of the sorption unit has a predominantly laminar flow and therefore experiences a foreseeable drying effect.

In addition, the drying device may have a second air distributor, which is arranged between the sorption unit and the treatment chamber. The second air distributor in particular is arranged opposite the first air distributor in such a way that the airflow is distributed uniformly over the entire drying material of the sorption unit. For this purpose, the second air distributor may be formed for example as a perforated sheet, slotted sheet or grill. For example, the airflow through the sorption unit can be easily controlled by perforated or slotted sheets or grids having different opening diameters. Larger opening diameters therefore clearly serve to reduce the flow resistance and to cause more air throughput, whereas smaller opening diameters increase the flow resistance and therefore reduce the aeration of the corresponding sub-area of the dry material. Of course, the formation of the first air distributor is not limited to the mentioned air lamellae, and instead perforated sheets, slotted sheets or grids may also be used here.

The reversibly dehydratable drying agent consists in accordance with the invention of 0.3 to 3 kg, preferably of 1 to 1.5 kg, of zeolite-containing material. As already indicated above, the drying effect of the drying device is dependent in particular on the quantity of the reversibly dehydratable dry material. It has been found that a quantity of 0.3 to 3 kg, preferably 1 to 1.5 kg, of zeolite-containing material over a thickness of 2 to 100 mm is sufficient to achieve the desired drying properties. More specifically, the zeolite-containing dry material is provided here in the form of a granulate having a diameter of 0.5 to 10 mm. Of course, the size and shape of the granulate is also decisive, since densely packed dry material clearly significantly increases the flow resistance, whereas the machine air can flow very easily through dry material having a relatively large diameter.

As already mentioned, the reversibly dehydratable dry material is heated during the desorption phase in order to again discharge the moisture introduced previously into the dry material. For this purpose, the drying device further has a heating unit for heating the reversibly dehydratable dry material as required, wherein the heating unit has an output of 1 to 14 kW, preferably 4 to 8 kW. The heating output of 1 to 14 kW is adapted in particular to the quantity of the dry material, such that a desorption time of a few minutes can be achieved. Furthermore, when selecting the heating output, it should be ensured that the surrounding housing of the drying unit is not damaged.

The heating unit preferably has a multiplicity of heating elements, which are arranged at uniform distances within the reversibly dehydratable dry material. In contrast to this, it is known from the prior art to arrange the heating elements of the heating unit in front of the dry material, and to heat said dry material with the aid of heated air. Due to the arrangement of a multiplicity of heating elements within the reversibly dehydratable dry material, large quantities of heat energy can advantageously be saved. In addition, the distribution of the heating elements at uniform distances ensures that the dehydratable dry material is heated particularly homogeneously. Here, the heating elements can be formed as plates or windings of a coil, which extend over the entire volume of the dry material.

In accordance with a further embodiment, the drying device of the warewasher according to the invention further has a heat exchanger unit, which is connected to the sorption unit in such a way that, when air is circulated, at least part of the airflow guided through the sorption unit then passes through the heat exchanger unit. This heat exchanger unit may have, for example, a heat exchanger cooled with water, in particular fresh water, and also an inlet connected or connectable to a fresh water feed line, and an outlet connected or connectable to the washing jet system of the warewasher and/or to the rinsing system of the warewasher. In this way, the heat discharged from the sorption unit during the desorption phase can be used to subsequently heat fresh water used as washing liquid or rinsing liquid.

Exemplary embodiments of the warewasher according to the invention will be described in greater detail hereinafter with reference to the accompanying drawings, in which.

Figure 1:
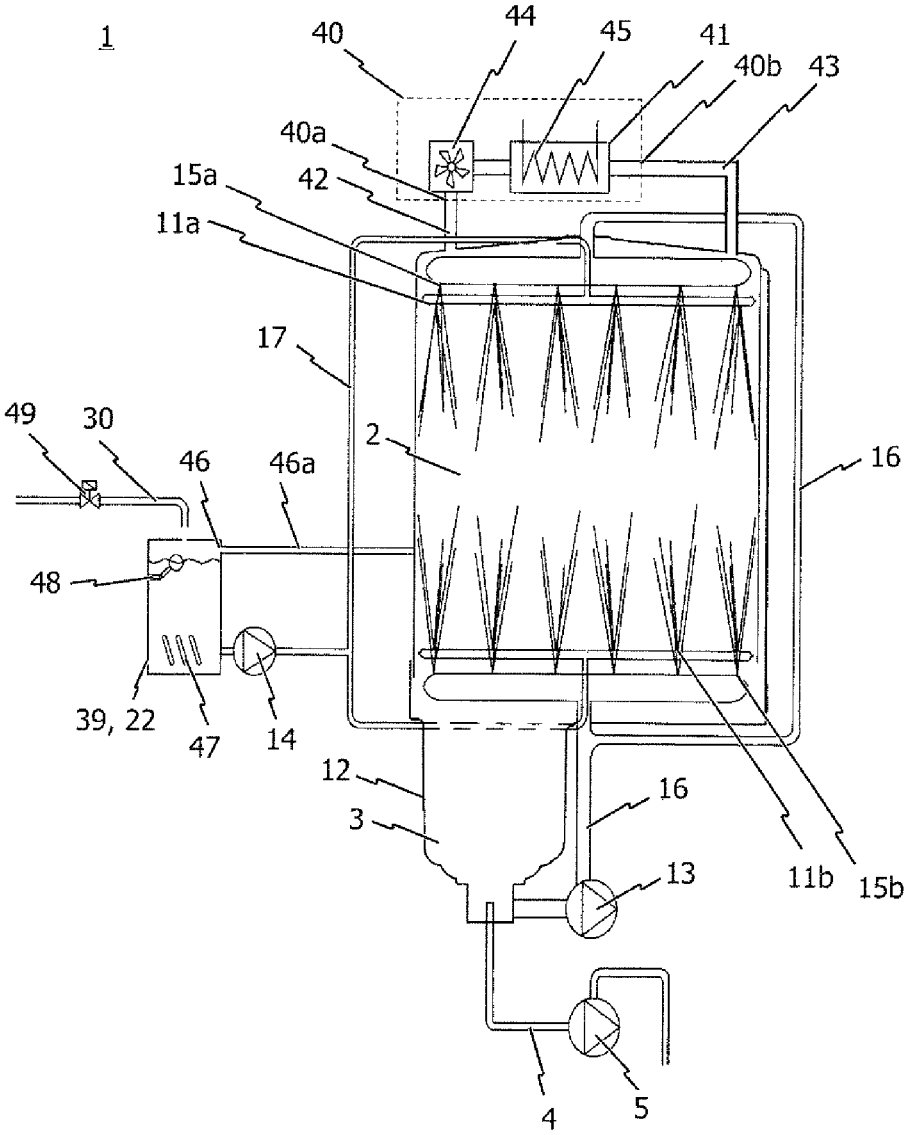
FIG. 1 shows a schematic view of a warewasher, in particular a commercial warewasher, in the form of a box-type warewasher in accordance with a first embodiment of the invention.

The invention relates to warewashers, in particular commercial warewashers for crockery or utensils, in the form of a box-type warewasher. They usually contain program control devices for controlling at least one cleaning program and a treatment chamber 2, which can be closed by a door (not shown) or a hood (not shown), in a machine housing for receiving items to be cleaned (not shown), such as crockery, cutlery, pots, pans, trays, transport containers, racks, preparation tools and also class I medical devices, in particular bedpans, and surgical instruments or components thereof.

A washing tank 12 for receiving sprayed liquid from the treatment chamber 2 is located beneath the treatment chamber 2. A washing pump 13 is provided to convey washing liquid from the washing tank 12 through a washing liquid line system 16 to washing jets 11*a*, 11*b* (e.g., from nozzles), which are directed in the treatment chamber 2 onto the area of the items to be cleaned. The sprayed washing liquid falls back into the washing tank 12 as a result of gravity. The washing tank 12, the washing pump 13, the washing liquid system 16 and the washing jets 11 therefore, together with the treatment chamber 2, form a washing liquid circuit. The washing liquid line system 16 connects the delivery side of the washing pump 13 to the washing jets 11*a*, 11*b*.

Further, a rinsing system for conveying rinsing liquid by means of a rinsing pump 14 through a rinsing line system 17 to rinsing jets 15*a*, 15*b* is provided, said rinsing jets being directed in the treatment chamber 2 onto the area of the items to be cleaned. The sprayed rinsing liquid falls from the treatment chamber 2 into the washing tank 12 as a result of gravity. The rinsing liquid system 17 connects the delivery side of the rinsing pump 14 to the rinsing jets 15*a*, 15*b*.

The washing jets 11*a*, 11*b* and the rinsing jets 15*a*, 15*b* can be arranged within the treatment chamber in the areas above and/or below the area of the items to be washed and, if desired, also to the side of said area, and in each case can be directed towards the area in which the items to be washed are positioned.

A multiplicity of washing jets 11*a* is preferably provided on at least one upper washing arm, a multiplicity of washing jets 11*b* is preferably provided on a lower washing arm, a multiplicity of rinsing jets 15*a* is preferably provided on at least one upper rinsing arm, and a multiplicity of rinsing jets 15*b* is preferably provided on at least one lower rinsing arm.

Before rinsing liquid is sprayed during the final rinse phase, a quantity of washing liquid corresponding to the rinsing liquid is drained from the washing tank 12 by means of a draining pump 5, of which the intake side is attached via a discharge line to a sump of the washing tank. If, before the warewasher 1 formed as a box-type warewasher is started for the first time, the washing tank 12 is empty, it must first be filled with fresh water via a fresh water line (not shown) or with fresh water or another rinsing liquid or washing liquid by means of the rinsing system and the rinsing pump 14 thereof.

The rinsing liquid may be fresh water or fresh water mixed with a rinsing aid. The washing liquid by contrast contains a cleaning agent (detergent), which is preferably automatically added in a metered manner to the liquid contained in the washing tank 12 by a cleaning agent metering apparatus (not shown). The above-mentioned program control device controls the washing pumps 13, the rinsing pump 14, the draining pump 5, the rinsing aid metering pump (not shown) and the cleaning agent solution pump (not shown) in accordance with the cleaning program selected by an operator at the program control device. At least one cleaning program is provided, and preferably a plurality of cleaning programs that can be selected electively.

From the embodiment of the warewasher 1 according to the invention illustrated in FIG. 1, a rinsing pump 14 is also attached via its intake side to an outlet of a boiler 22. The boiler 22 furthermore comprises an inlet, which is connected to a fresh water feed line 30 and via which either fresh water or fresh water with rinsing aid added by metering is fed to the boiler 22. In the boiler 22, the liquid fed via the inlet (pure fresh water or fresh water with rinsing aid added by metering) is heated once a process sequence has been specified. By means of the rinsing pump 14 attached via its intake side to the boiler outlet, the rinsing liquid heated in the boiler 22 can be fed for example during a fresh water rinsing phase to the rinsing jets 15*a* and 15*b* via the rinsing line system 17. The rinsing jets 15*a* or 15*b* are arranged in the treatment chamber 2 in order to spray the rinsing liquid heated in the boiler 22 over the items to be washed in the treatment chamber 2. Of course, it is also conceivable for pure fresh water to be fed to the boiler via the inlet into the fresh water feed line 30, said fresh water being supplemented with a rinsing aid added in a metered manner after heating in the boiler.

Figure 2:
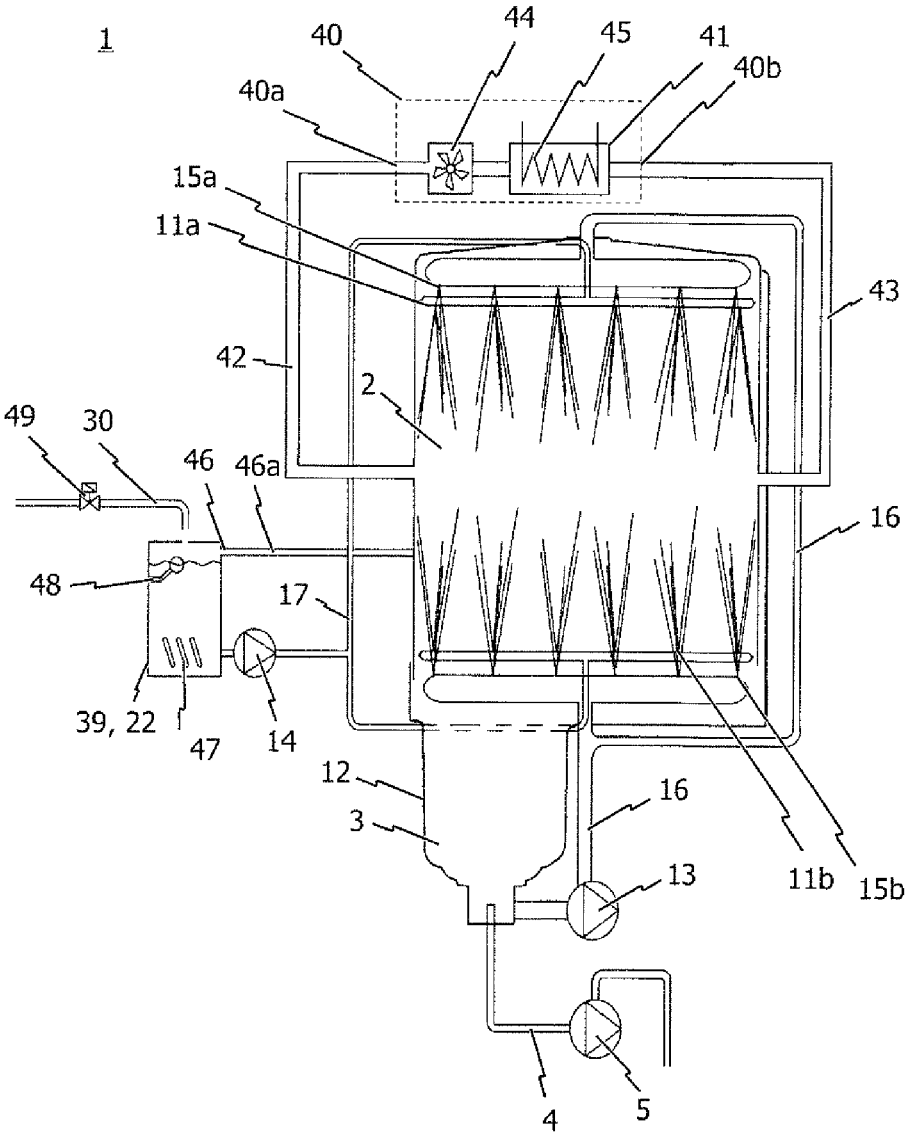
FIG. 2 shows a schematic view of a warewasher, in particular a commercial warewasher, in the form of a box-type warewasher in accordance with a second embodiment of the invention.

In the embodiment of the warewasher 1 according to the invention illustrated in FIGS. 1 and 2, the rinsing system has a preferably electrically operated steam generator 39, which, as illustrated in the figures, can be integrated into the boiler 22 for example. In this case, a corresponding steam outlet 46 of the steam generator 39 is formed on the upper area of the boiler 22. The steam outlet 46 of the steam generator 39 is connected via a steam line 46*a* at a point positioned above the washing tank 12 to the treatment chamber 2, in order to introduce as required into said treatment chamber the steam generated in the steam generator 39. The outlet opening of the steam line 40*b* is preferably located between the upper jets 11*a*, 15*a* of the washing system or fresh water rinsing system and the lower jets 11*b*, 15*b*. Of course, other positions are also possible.

A heater 47 is located in the boiler 22, which in accordance with the embodiments illustrated in FIGS. 1 and 2 is not only used to heat the rinsing liquid, but also to generate steam as required. Furthermore, a level sensor 48 can be arranged in or on the boiler 22 and for example controls a valve 49 of the fresh water line 30.

The warewasher 1 according to the invention further has a drying device 40 for removing moisture from the drying air circulating in the treatment chamber 2, either continuously or as required. The drying device 40 has at least one sorption unit having a reversibly dehydratable dry material. This sorption unit 41 is normally a container in which a reversibly dehydratable dry material is filled. This dry material is preferably a sorption agent, which comprises zeolite. In particular, type Y zeolite is suitable as dry material, since this material is particularly stable, even under extreme hydrothermal conditions. The drying device further comprises at least one fan 44 for circulating air as required, in such a way that at least part of the air is guided from the treatment chamber 2 via an air inlet 40*a* through the sorption unit 41 and is then fed again to the treatment chamber 2 via an air outlet 40*b*.

As can be deduced in particular in FIGS. 1 and 2, the drying device 40 is arranged above the treatment chamber 2. In other words, the drying device 40 with the fan 44 and the sorption unit 41 is preferably assembled on the top of the warewasher 1. This has the advantage for example that the above-mentioned washing liquid can only reach the interior of the drying device 40 with difficulty and therefore flows back exclusively into the washing tank 12 under the action of gravity. The dry material located in the sorption unit 41 is therefore effectively protected against splashed water and condensation water.

The air inlet 40*a* of the drying device 40 is preferably connected via an inlet line 42 to the treatment chamber 2, wherein the inlet line 42 is connected from the side (FIG. 2) or from above (FIG. 1) to the treatment chamber 2. As an equivalent thereto, the air outlet 40*b* of the drying device is preferably connected via an outlet line 43 to the treatment chamber 2, wherein the outlet line 43 is connected from the side (FIG. 2) or from above (FIG. 1) to the treatment chamber 2. It should be mentioned at this juncture that the inlet or outlet lines 42, 43 may each have a valve for closing the connection between the treatment chamber and drying device 40 as required. By means of the inlet or outlet lines 42, 43, air can be circulated with the aid of the associated fan 44 as required in such a way that at least part of the air is drawn from the treatment chamber 2 and is fed via the inlet line 42 to the sorption unit 41. This air drawn from the treatment chamber 2 is then guided through the sorption unit 41 and the dry material and is then fed again to the treatment chamber 2 via the outlet 40*b* of the drying unit 40 and via the outlet line 43.

In order to be able to regenerate the dry material of the sorption unit 41 during the desorption phase, it may be necessary, as already discussed, to heat the dry material accordingly. For this purpose, a heating device 45, which for example is electrically operated, is associated with the sorption unit 41 in the embodiments of the warewasher 1 according to the invention illustrated in drawings 1 and 2 and is designed to heat the dry material of the sorption unit 41 during a desorption phase or immediately before initiation of the desorption phase as required. The sub-process of desorption is carried out subsequently to the absorption phase, more specifically by feeding heat, for example in the form of electrical energy, water vapor, gas or hot water, to the sorption unit 41. At the same time or at a different time, air from the treatment chamber 2 of the warewasher 1 is blown through the sorption unit 41 in the desorption phase with the aid of the fan 44 via the inlet line 43 and absorbs the water desorbed in the form of water vapor from the dry material.

The heating unit 45, illustrated merely schematically, may have a multiplicity of heating elements, which are arranged at a uniform distance within the reversibly dehydratable material. Here, the heating elements may be heating rods or heating plates for example, which are distributed over the entire volume of the sorption unit 41. Due to the strong absorption forces with respect to water, the dry material should be heated for example to more than 300° in order to obtain the lowest possible residual moisture content within the dry material. The multiplicity of heating elements (not illustrated) should therefore in particular be removed far enough from the housing walls of the drying device 40, such that said housing walls are not damaged by the high temperatures of up to 400°.

Figure 3:
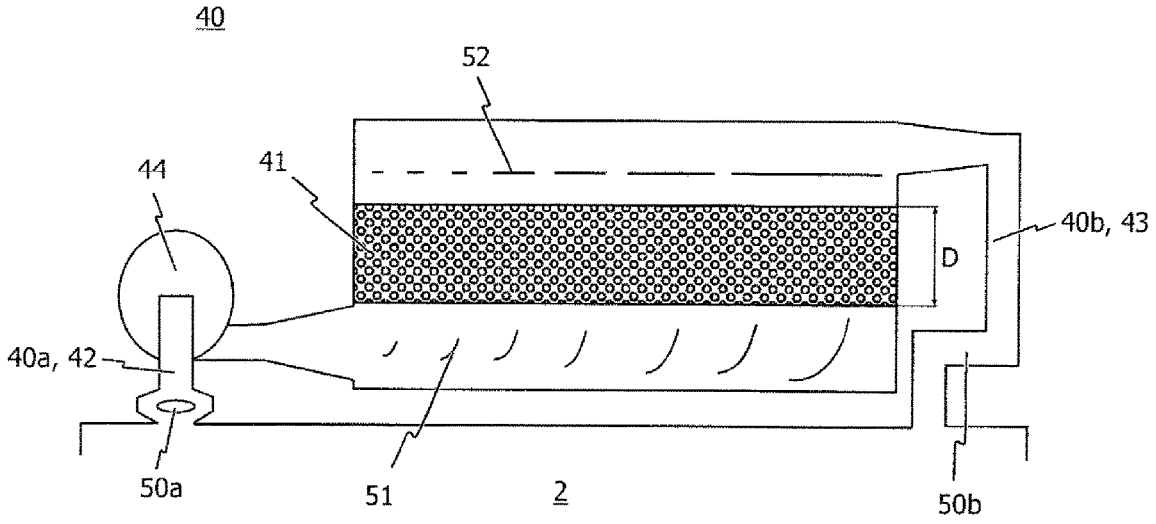
FIG. 3 shows a schematic view of a first embodiment of a drying unit of the warewasher according to the invention.
Figure 4:
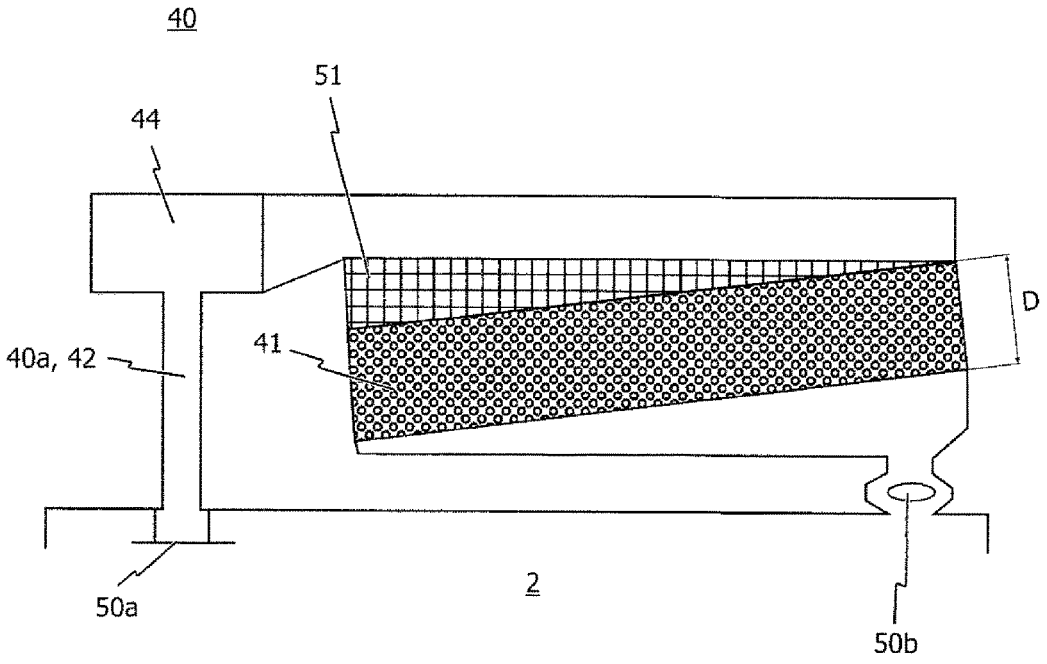
FIG. 4 shows a schematic view of a second embodiment of a drying unit for a warewasher according to the invention.

Schematic views of two different embodiments of the drying device 40 are illustrated in FIGS. 3 and 4. Here, the drying devices are connected via an air inlet 40*a*, and also via an air outlet 40*b*, to the treatment chamber 2. In order to effectively protect the sorption unit 41 against splashed water from the treatment chamber 2, the drying device 40 of the warewasher 1 has a first splash protection apparatus 50*a* between the air inlet 40*a* and the treatment chamber 2. Additionally or alternatively, the warewasher may have a second splash protection apparatus 50*b* between the air outlet 40*b* and the treatment chamber 2. The splash protection apparatuses illustrated schematically in FIGS. 3 and 4 are curved lines, protective covers or lines with an obstacle for example. Of course, the splash apparatuses are not limited to the exemplary embodiments illustrated.

Inside the drying unit 40, a sorption unit 41 is located, which consists of a reversibly dehydratable dry material that is held by a housing structure (for example perforated sheets), which is not illustrated. Here, the sorption unit 41 is formed in particular in such a way that it has a thickness D of 2 to 100 mm, preferably 10 to 50 mm and more preferably to 40 mm, along the direction of flow of the airflow guided from the treatment chamber 2. The thickness of 2 to 100 mm ensures that the moist machine air is sufficiently dried without having to accept an excessively high flow resistance.

The drying device 40 advantageously has a first air distributor 51, which is arranged between the fan 44 and sorption unit 41 and is designed to direct the airflow perpendicular to an entry surface of the sorption unit 41. In the embodiment according to FIG. 3, the first air distributor 51 accordingly has a multiplicity of air lamellae, which are curved in such a way that the airflow conveyed by the fan 44 is deflected at an angle of approximately 90° onto the sorption unit 41. The individual air lamellae here increase in size with increasing distance from the fan 44, whereby a uniform distribution of the airflow is ensured over the entire length of the sorption unit 41. The situation is similar with the air distributor 51 illustrated in FIG. 4, which is formed as a grid. With increasing distance from the fan 44, the thickness of the grid that has to be penetrated by the airflow in order to reach the sorption unit 41 reduces. It is again thus ensured that air also flows in equal proportions through the rear areas (on the right-hand side in the illustration). In other words, the flow resistance of the first air distributor illustrated in FIG. 4 decreases with increasing distance from the fan 44, whereby a uniform distribution of the airflow within the sorption unit 41 is ensured.

The drying device 40 may further have a second air distributor 52, as is illustrated in FIG. 3 for example. The second air distributor 52 is preferably arranged between the sorption unit 41 and the treatment chamber 2. Here, the second air distributor 52 is arranged in relation to the first air distributor 51 in such a way that the airflow is distributed uniformly over the entire dry material of the sorption unit 41. More specifically, the airflow within the sorption material 41 can preferably be influenced by the second air distributor 52. For this purpose, the second air distributor is preferably formed as a perforated sheet or slotted sheet, wherein said sheet has an inhomogeneous distribution of openings. At points with a plurality of openings or larger openings, an increased airflow can therefore be forced through the sorption unit 41, whereas there is a reduced flow in the sorption unit 41 as a result of the increased flow resistance at points with fewer or smaller openings or slits. Due to a clever combination of the first and second air distributors 51, 52, a particularly homogeneous distribution of the airflow can be achieved over the entire dry material of the sorption unit 41.

The method according to the invention for operating a warewasher 1 provided as a box-type warewasher will be explained in greater detail hereinafter on the basis of the exemplary embodiments illustrated in FIGS. 1 to 4:

In a first method step, during an absorption phase, air is guided from the treatment chamber 2 through a sorption unit 41 having a reversibly dehydratable dry material, in such a way that the dry material absorbs moisture from the airflow, wherein the air is then fed again to the treatment chamber 2. During this "absorption phase", in which moisture from air removed from the treatment chamber 2 is adsorbed by the dry material of the sorption unit 41, adsorption heat is also released, as a result of which the air, which has been guided through the sorption unit 41, is accordingly heated. The hot air dried once it has passed through the sorption unit 41 is fed back into the treatment chamber 2 of the warewasher 1 and can be used to dry the washed items received in the treatment chamber 2. In this regard, it is preferable if the adsorption phase of the sorption unit 41 takes place at the same time as the drying phase of the warewasher 1 or chronologically overlaps with the drying phase of the warewasher 1 in order to be able to use the heat released during the adsorption of moisture from the dry material of the sorption unit 41 to dry the washed items. Due to the higher air temperature, a significant improvement of the drying quality specifically for items made of plastics material is possible here. In particular, the drying time can thus also be considerably reduced in some circumstances. This is a key factor, in particular in the case of commercial washing.

A second method step of the method according to the invention constitutes the desorption phase, during which the dry material of the sorption unit 41 is heated and air is guided from the treatment chamber 2 through the sorption unit 41 having the heated dry material. In so doing, moisture is desorbed from the dry material and at least some of the thermal energy introduced previously into the dry material as well as at least some of the moisture desorbed from the dry material is discharged from the sorption unit 41 in the form of water vapor with the aid of the airflow guided through the sorption unit 41. The water vapor produced here can be used for example to steam clean the items during the final rinse phase. In this regard, it is preferable if the second method step, that is to say the desorption phase, takes place at least partly during the final rinse phase in order to be able to use the water vapor produced during the desorption process for further cleaning of the items to be washed.

It should be noted at this juncture that the quantity of moisture in the dry material of the sorption unit 41 can be established continuously or at predefinable times or events during the adsorption phase and/or the desorption phase. This is achieved in particular by a sensor unit, which for example measures the weight of the dry material, the duration of the desorption phase, the moisture content, or the temperature of the air at the air outlet of the drying device. The sensor unit (not illustrated) together with the program control unit can therefore be used to initiate the different program sequences on the basis of the moisture content of the dry material.

It is also preferred if the adsorption phase requires 30 sec. to 5 min., preferably 1 min. to 3 min. By contrast, the desorption phase may take place within 5 sec. to 5 min., preferably 20 sec. to 3 min., and more preferably 1 min. to 2 min.

The invention is not limited to the embodiments of a warewasher according to the invention illustrated in the figures, but is also provided from an overview of all features disclosed herein. In particular, the invention can also be applied equivalently to the technical field of tumble dryers. It should also be mentioned that the drying device 40 is not limited to having an individual fan 44 and also an individual sorption unit 41, but can by all means comprise two or more of these components. As has already been mentioned above, the drying device 40 may also for example have a heat exchanger (not illustrated), which serves for further reduction of the energy consumption.

LIST OF REFERENCE SIGNS

1 warewasher
2 treatment chamber
3 washing water
4 discharge
5 draining pump
11*a*, 11*b* washing jets
12 washing tank
13 washing pump
14 rinsing pump
15*a*, 15*b* rinsing jets
16 washing liquid line system
17 rinsing liquid line system
22 boiler
30 fresh water feed line
39 steam generator
40 drying unit
40*a* air inlet
40*b* air outlet
41 sorption unit
42 inlet line
43 outlet line
44 fan
45 heating unit
46 steam outlet
46*a* steam line
47 heater
48 level sensor
49 valve
50*a* first splash protection apparatus
50*b* second splash protection apparatus
51 first air distributor
52 second air distributor

The invention claimed is:

1. A warewasher comprising:

a treatment chamber (2), into which and from which items can be introduced and removed manually;

a tank (12), into which liquid from the treatment chamber (2) can flow as a result of gravity;

a washing system comprising a washing pump (13) and a washing line system (16) for conveying washing liquid during a washing phase from the tank (12) and for spraying the washing liquid through washing jets (11*a*, 11*b*) in the treatment chamber (2);

a fresh water rinsing system comprising at least one rinsing pump (14; 14*a*, 14*b*) and at least one rinsing line system (17, 17*a*, 17*b*) for conveying rinsing liquid during a fresh water rinsing phase from a fresh water feed device and for spraying the rinsing liquid through rinsing jets (15*a*, 15*b*) in the treatment chamber (2);

a drying device (40) for removing moisture from drying air circulating in the treatment chamber (2), wherein the drying device (40) has at least one sorption unit (41) having a reversibly dehydratable dry material as well as at least one fan (44) for circulating air in such a way that air is guided through the sorption unit (41) and is then fed again to the treatment chamber (2), wherein the drying device (40) is arranged above the treatment chamber (2);

wherein the drying device (40) has an air inlet (40*a*), which is connected via an inlet line (42) to the treatment chamber, wherein the inlet line (42) is connected laterally or from above to the treatment chamber (2);

wherein the drying device (40) has an air outlet (40*b*), which is connected via an outlet line (43) to the treatment chamber (2), wherein the outlet line (43) is connected laterally or from above to the treatment chamber (2);

wherein the drying device (40) further has a heating unit (45) for heating the reversibly dehydratable dry material, and wherein the heating unit (45) has an output of 1 to 14 kW; wherein the heating unit (45) has a multiplicity of heating elements, which are arranged at uniform distances within the reversibly dehydratable dry material.

2. A warewasher comprising:

a treatment chamber (2), into which and from which items can be introduced and removed manually;

a tank (12), into which liquid from the treatment chamber (2) can flow as a result of gravity;

a washing system comprising a washing pump (13) and a washing line system (16) for conveying washing liquid during a washing phase from the tank (12) and for spraying the washing liquid through washing jets (11*a*, 11*b*) in the treatment chamber (2);

a fresh water rinsing system comprising at least one rinsing pump (14; 14*a*, 14*b*) and at least one rinsing line system (17, 17*a*, 17*b*) for conveying rinsing liquid during a fresh water rinsing phase from a fresh water feed device and for spraying the rinsing liquid through rinsing jets (15*a*, 15*b*) in the treatment chamber (2);

a drying device (40) for removing moisture from drying air circulating in the treatment chamber (2), wherein the drying device (40) has at least one sorption unit (41) having a reversibly dehydratable dry material as well as at least one fan (44) for circulating air in such a way that air is guided through the sorption unit (41) and is then fed again to the treatment chamber (2), wherein the drying device (40) is arranged above the treatment chamber (2);

wherein the drying device (40) has an air inlet (40*a*), which is connected via an inlet line (42) to the treatment chamber, wherein the inlet line (42) is connected laterally or from above to the treatment chamber (2);

wherein the drying device (40) has an air outlet (40*b*), which is connected via an outlet line (43) to the treatment chamber (2), wherein the outlet line (43) is connected laterally or from above to the treatment chamber (2);

wherein the warewasher (1) has a first splash protection apparatus (50*a*) between the air inlet (40*a*) and the treatment chamber (2) to limit water entry from the treatment chamber (2) into the air inlet (40*a*) and/or a second splash protection device (50*b*) between the air outlet (40*b*) and the treatment chamber (2) to limit water entry from the treatment chamber (2) into the air outlet (40*b*).

3. The warewasher (1) as claimed in claim 1, wherein the sorption unit (41) has a thickness (D) of 2 to 100 mm along the direction of flow of the airflow guided from the treatment chamber (2).

4. A warewasher comprising:

a treatment chamber (2), into which and from which items can be introduced and removed manually;

a tank (12), into which liquid from the treatment chamber (2) can flow as a result of gravity;

a washing system comprising a washing pump (13) and a washing line system (16) for conveying washing liquid during a washing phase from the tank (12) and for spraying the washing liquid through washing jets (11*a*, 11*b*) in the treatment chamber (2);

a fresh water rinsing system comprising at least one rinsing pump (14; 14*a*, 14*b*) and at least one rinsing line system (17, 17*a*, 17*b*) for conveying rinsing liquid during a fresh water rinsing phase from a fresh water feed device and for spraying the rinsing liquid through rinsing jets (15*a*, 15*b*) in the treatment chamber (2);

a drying device (40) for removing moisture from drying air circulating in the treatment chamber (2), wherein the drying device (40) has at least one sorption unit (41) having a reversibly dehydratable dry material as well as at least one fan (44) for circulating air in such a way that air is guided through the sorption unit (41) and is then fed again to the treatment chamber (2), wherein the drying device (40) is arranged above the treatment chamber (2);

wherein the drying device (40) has an air inlet (40*a*), which is connected via an inlet line (42) to the treatment chamber, wherein the inlet line (42) is connected laterally or from above to the treatment chamber (2);

wherein the drying device (40) has an air outlet (40*b*), which is connected via an outlet line (43) to the treatment chamber (2), wherein the outlet line (43) is connected laterally or from above to the treatment chamber (2);

wherein the drying device (40) has a first air distributor (51), which is arranged between the fan (44) and the sorption unit (41) and is designed to direct the airflow perpendicular to an entry surface of the sorption unit (41).

5. The warewasher (1) as claimed in claim 4, wherein the first air distributor (51) consists of a multiplicity of air lamellae.

6. The warewasher (1) as claimed in claim 4, wherein the drying device (40) further has a second air distributor (52), which is arranged between the sorption unit (41) and the treatment chamber (2), wherein the second air distributor (52) is arranged opposite the first air distributor (51) in such a way that the airflow is distributed uniformly over the entire dry material of the sorption unit (41).

7. The warewasher (1) as claimed in claim 1, wherein the reversibly dehydratable dry material consists of 0.3 to 3 kg of zeolite-containing material.

8. The warewasher (1) as claimed in claim 7, wherein the zeolite-containing material of the dry material is provided in the form of a granulate having a diameter of 0.5 to 10 mm.

9. The warewasher (1) as claimed in claim 1, wherein the drying device (40) further has a heat exchanger unit, which is connected to the sorption unit (41) in such a way that, when air is circulated, at least part of the airflow guided through the sorption unit (41) also passes through the heat exchanger unit.

* * * * *